US008971744B2

(12) United States Patent
Nihonyanagi et al.

(10) Patent No.: US 8,971,744 B2
(45) Date of Patent: Mar. 3, 2015

(54) IMAGE HEATING APPARATUS

(75) Inventors: Koji Nihonyanagi, Susono (JP); Kuniaki Kasuga, Mishima (JP); Yutaka Sato, Tokyo (JP); Takashi Narahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 13/547,536

(22) Filed: Jul. 12, 2012

(65) Prior Publication Data

US 2013/0028622 A1 Jan. 31, 2013

(30) Foreign Application Priority Data

Jul. 29, 2011 (JP) ..... 2011-166701

(51) Int. Cl.
*G03G 15/20* (2006.01)
*H05B 1/02* (2006.01)
*H05B 6/10* (2006.01)

(52) U.S. Cl.
CPC ..... *H05B 1/0241* (2013.01); *G03G 15/2046* (2013.01); *G03G 15/2053* (2013.01); *G03G 15/2064* (2013.01); *H05B 6/107* (2013.01)
USPC ..... 399/67; 399/69; 399/328; 399/329; 219/216

(58) Field of Classification Search
USPC ..... 399/67, 69, 70, 328–331
See application file for complete search history.

(56) References Cited

U.S. PATENT DOCUMENTS 6,782,231 B2 * 8/2004 Fuma et al. ..... 399/328
7,155,136 B2 12/2006 Nihonyanagi et al.
7,190,914 B2 3/2007 Nihonyanagi et al.
7,215,899 B2 5/2007 Kimizuka et al.
7,251,447 B2 7/2007 Kanamori et al.
7,382,995 B2 6/2008 Itoh et al.
7,389,079 B2 6/2008 Narahara et al.
7,518,089 B2 4/2009 Hashiguchi et al.
2004/0192528 A1 9/2004 Fukase et al.
2007/0047991 A1 3/2007 Itoh et al.
2010/0316404 A1 12/2010 Fukuzawa et al.
2011/0150545 A1 6/2011 Nihonyanagi et al.

(Continued)

FOREIGN PATENT DOCUMENTS

CN 1834820 A 9/2006
JP 2000-194225 A 7/2000

(Continued)

OTHER PUBLICATIONS

Chinese Office Action dated Jul. 31, 2014, issued in counterpart Chinese Application No. 201210257620.4, and English-language translation thereof.

*Primary Examiner* — Hoang Ngo
(74) *Attorney, Agent, or Firm* — Fitzpatrick, Cella, Harper & Scinto

(57) ABSTRACT

The image heating apparatus includes an unit for spacing each of a buck-up member and a pressure roller apart from a flexible belt member which is electrified to generate heat, or heated by a source of heat at start-up, i.e. in a previous stage to heating an image, or an unit for controlling a pressure to decrease a contact area in the direction of the axis of rotation compared with the contact area for a period to heat an image. This can control, as much as possible, heat conduction from the flexible belt which is electrified to generate heat, or heated by the source of heat to the back-up member and the pressure roller at the start-up, i.e. the previous stage to heating an image.

25 Claims, 5 Drawing Sheets

(56) References Cited

U.S. PATENT DOCUMENTS

| | | | |
|---|---|---|---|
| 2012/0020709 | A1 | 1/2012 | Uchiyama et al. |
| 2012/0121306 | A1 | 5/2012 | Shimura et al. |
| 2012/0148281 | A1 | 6/2012 | Fukuzawa et al. |
| 2012/0201582 | A1 | 8/2012 | Shimura et al. |

FOREIGN PATENT DOCUMENTS

| | | | |
|---|---|---|---|
| JP | 2003-131503 | A | 5/2003 |
| JP | 2007-057827 | A | 3/2007 |
| JP | 2011-053598 | A | 3/2011 |

* cited by examiner

IMAGE HEATING APPARATUS

BACKGROUND OF THE INVENTION

1. Field of the Invention

The present invention relates to an image heating apparatus used for an image forming apparatus, such as copiers and laser beam printers, employing an image-forming process, such as electrophotography and electrostatic recording.

2. Description of the Related Art

Some image heating apparatuses used for an image forming apparatus may have a cylindrical belt, a nip portion forming member in contact with an inner surface of the belt, and a pressure member for forming a nip portion through the belt together with the nip portion forming member. The image heating apparatus described above may generally heat a toner image while conveying a recording material which bears the toner image by the nip portion. The image heating apparatus described above may be adapted to have the belt formed thin so that heat capacity can be small, thereby allowing for the merit of a shorter period needed to warm up the image heating apparatus.

And now, recently, there has been required a technology for further shortening the warm-up period. Japanese Patent Application Laid-Open No. 2007-57827 discloses an apparatus configured in a manner that, at warm-up operation, a fixing belt having an electrically conductive layer is spaced apart from a pressure member, and the fixing belt is brought into contact with the pressure member after the fixing belt reaches a fixable temperature.

However, in the case of the image heating apparatus disclosed in Japanese Patent Application Laid-Open No. 2007-57827, the fixing belt is locally heated due to electromagnetic induction, and accordingly the fixing belt has to be configured so that it can be driven to rotate for warming the entire circumference of the fixing belt at warm-up even if the fixing belt is spaced apart from the pressure member. If the fixing belt, as shown in Japanese Patent Application Laid-Open No. 2007-57827, is driven using an end cap attached to an end of the fixing belt, and a drive gear, then the fixing belt needs to have rigidity to some extent. However, an increase in thickness and rigidity of the fixing belt leads to a larger heat capacity of the fixing belt, resulting in a longer warm-up time. Accordingly, even if the fixing belt is spaced apart from the pressure member at warm-up in a configuration in which the fixing belt is locally heated, a shortening effect of the warm-up time may be unfortunately reduced.

SUMMARY OF THE INVENTION

A purpose of the present invention is to provide an image heating apparatus configured so that a belt is not easily deprived of heat by a pressure roller at warm-up of the image heating apparatus, and the belt rises rapidly in temperature.

Another purpose of the present invention is to provide an image heating apparatus for conveying a recording material which bears a toner image by a nip portion and heating the toner image, including a tubular belt with a heat generating layer electrified to self-generate heat over the entire circumference; a nip portion forming member that contacts an inner surface of the belt; and a pressure roller that forms the nip portion through the belt together with the nip portion forming member, the pressure roller driven by a driving source and driving the belt to rotate in the nip portion, wherein in the image heating apparatus for a predetermined period from the start of warming up the image heating apparatus, a contact area between the belt and the pressure roller is smaller than a contact area for a period to heat a toner image, or the belt does not contact the pressure roller, and the belt stops rotating, and wherein for a period from a completion of the predetermined period to the start of a period to heat a toner image, the contact area between the belt and the pressure roller is made to be equal to the contact area for the period to heat a toner image and the belt is rotated.

A further purpose of the present invention is to provide an image heating apparatus for conveying a recording material which bears a toner image by a nip portion and heating the toner image, including a belt having a cylinder shape with a heat generating layer heated by electromagnetic induction over the entire circumference; a nip portion forming member that contacts an inner surface of the belt; and a pressure roller that forms the nip portion through the belt together with the nip portion forming member, the pressure roller driven by a driving source and driving the belt to rotate in the nip portion, wherein in the image heating apparatus for a predetermined period from the start of warming up the image heating apparatus, a contact area between the belt and the pressure roller is smaller than a contact area for a period to heat a toner image, or the belt does not contact the pressure roller, and the belt stops rotating, and wherein for a period from a completion of the predetermined period to the start of a period to heat a toner image, the contact area between the belt and the pressure roller is made to be equal to the contact area for the period to heat a toner image and the belt is rotated.

The present invention can provide an image heating apparatus configured so that a belt is not easily deprived of heat by a pressure roller at warm-up of the image heating apparatus, and the belt rises rapidly in temperature.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A first exemplary embodiment is described.

(Image Forming Apparatus)

Figure 3:
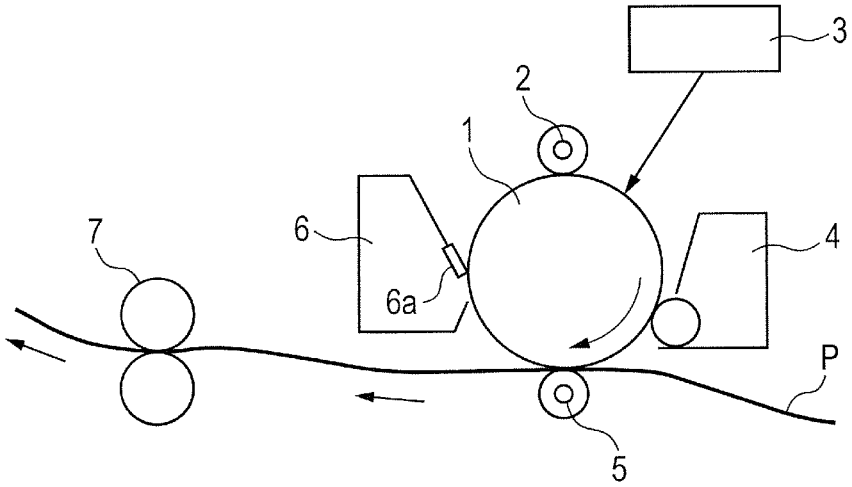
FIG. 3 schematically illustrates one example of a configuration of an image forming apparatus.

FIG. 3 schematically illustrates one example of a configuration of an image forming apparatus which mounts an image heating apparatus according to an exemplary embodiment of the present invention. This image forming apparatus is a laser beam printer (hereinafter, called a "printer") which forms, using electrophotography, an image on a recording material such as a recording paper and an OHP sheet. The printer shown in this exemplary embodiment is configured so that a controller (not shown) executes a predetermined control sequence for image forming in response to a print command output by an external apparatus (not shown) such as a host computer, and performs a predetermined operation for image forming according to this control sequence for image forming. The controller includes a central processing unit (CPU) and a memory such as a ROM and a RAM, and the memory stores the control sequence for image forming and various types of programs needed for image forming.

The printer as the image forming apparatus according to this exemplary embodiment includes an image forming portion for forming a toner image on a recording material, and a fixing portion (hereinafter, called a "fixing apparatus") used as an image heating apparatus for heating and fixing an unfixed toner image on the recording material. When the control sequence for image forming is executed, first, in the image forming portion, an electrophotographic photosensitive member of drum type 1 (hereinafter called a "photosensitive drum 1") used as an image bearing body is driven to rotate at a predetermined peripheral speed (process speed) in the direction shown by the arrow. An outer periphery (surface) of this photosensitive drum 1 is, then, electrically charged uniformly by a charged roller 2 used as a charged member.

Subsequently, to the charged surface of this photosensitive drum 1, scan exposure of laser beams is applied, which laser beams are on/off controlled by an optical scanning apparatus 3 depending on image information, and on the charged surface of this photosensitive drum 1, an electrostatic latent image is formed based on the image information. This electrostatic latent image is then developed as a toner image by a development apparatus 4 using toner (developer).

On the other hand, a recording material P fed from a feeding cassette (not shown) by a recording material conveyance mechanism (not shown) is conveyed to a transfer nip portion between the surface of the photosensitive drum 1 and an outer periphery (surface) of a transfer roller 5 used as a transfer member. This recording material P is sandwiched in the transfer nip portion between the surface of the photosensitive drum 1 and the surface of the transfer roller 5 and conveyed, so that the toner image on the surface of the photosensitive drum 1 is transferred onto the recording material P by the transfer roller 5 in the conveyance process of the recording material P. As the result, the recording material P bears the toner image.

The recording material P which bears the toner image is introduced into a fixing apparatus 7, which applies heat and a pressure to the toner image to fix, under heat, on the recording material P. The recording material P on which the toner image is fixed under heat is ejected onto a receiver tray (not show) by a recording material ejection mechanism (not shown).

Residual toner which stays behind on the surface of the photosensitive drum 1 after the toner image is transferred is removed by a cleaning blade 6*a* of a cleaning apparatus 6 and used for subsequent image forming.

(Fixing Apparatus)

A fixing apparatus used as an image heating apparatus according to an exemplary embodiment of the present invention will be described below. The term "longitudinal direction", as used relative to the fixing apparatus and a member for forming the fixing apparatus, is the direction perpendicular to a recording material conveyance direction in a surface of the recording material (the direction of the axis of rotation of a fixing belt described below). The term "lateral direction" is the direction parallel to the recording material conveyance direction in the surface of the recording material. Further, the term "length" is the dimension in the longitudinal direction, and "width" is the dimension in the lateral direction.

Figure 1A:
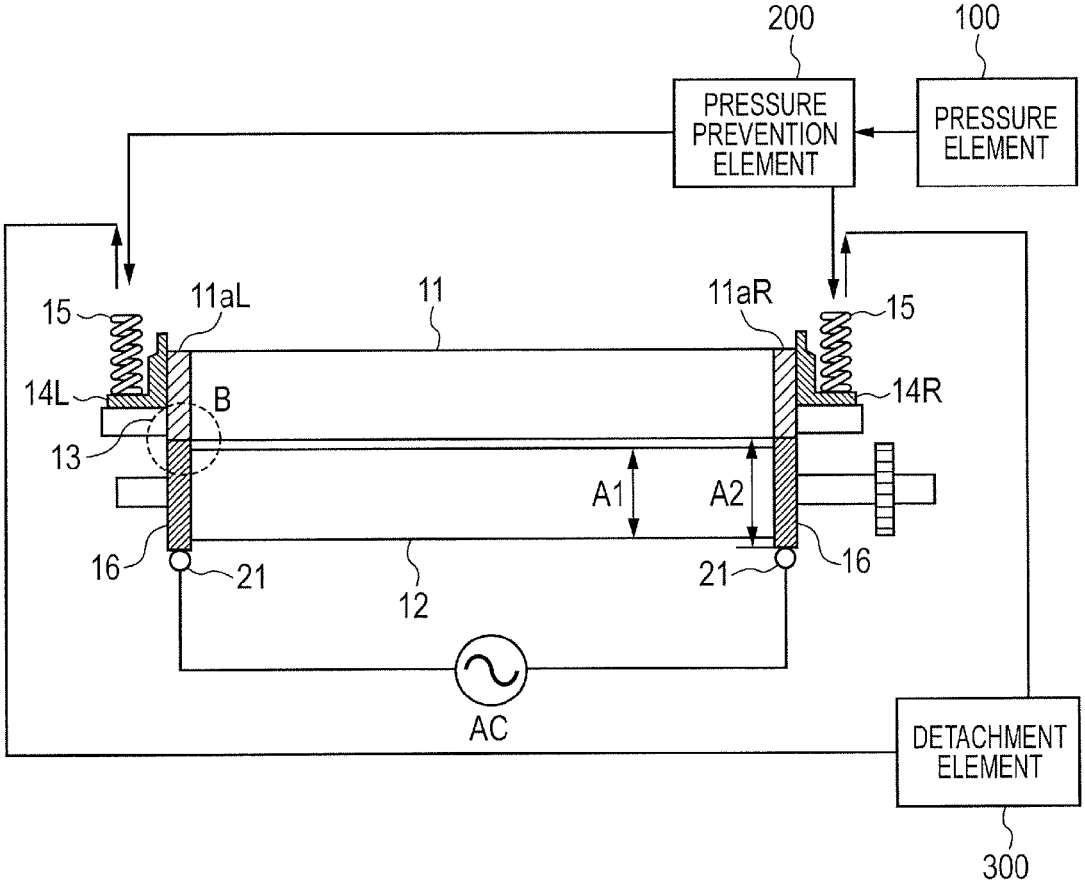
FIG. 1A schematically illustrates a configuration of an image heating apparatus in a vertical-sectional view.
Figure 1B:
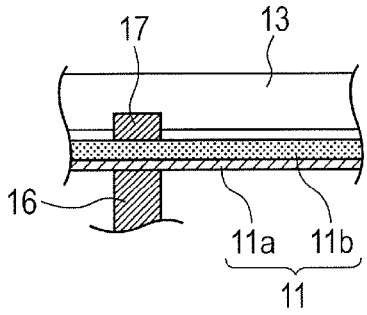
FIG. 1B schematically illustrates a configuration of an enlarged power supply area of a heat generating layer of a belt.
Figure 2:
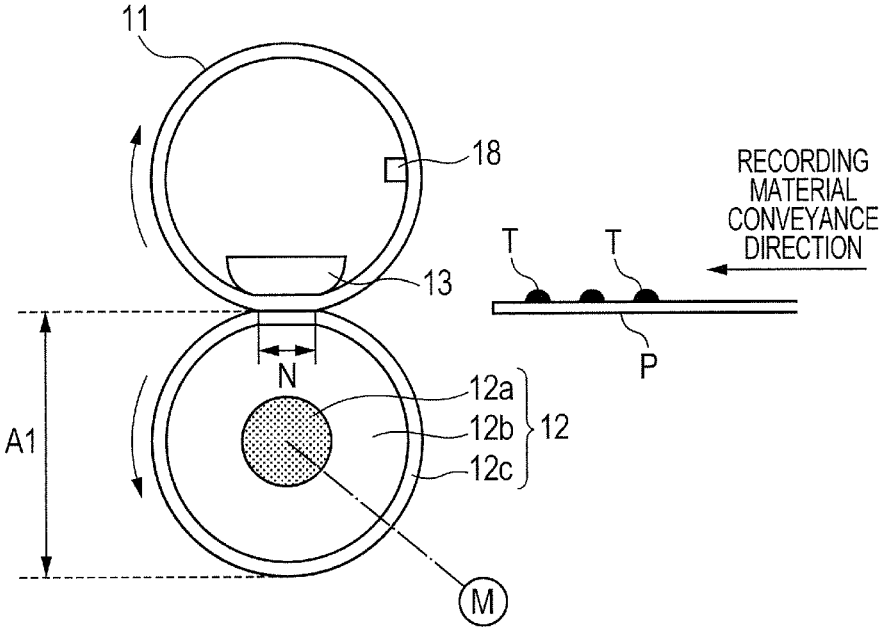
FIG. 2 schematically illustrates a configuration of the image heating apparatus in a cross-sectional view.

FIGS. 1 and 2 illustrate a configuration of a fixing apparatus 7 used as an image heating apparatus according to an exemplary embodiment. The fixing apparatus 7 is a device configured in a manner that a fixing belt having an electrification heat-generating resistance layer (heat generating layer) described later, self-generates heat. A fixing belt 11, which is a rotating body for heat generation having rotatable flexibility, is configured so that its inner periphery is rotatably supported by a belt guide 13 which is a nip portion forming member, and its side end plane is also rotatably supported by a right and left flange 14. And, an inner periphery of the fixing belt is in contact with the belt guide 13, and an outer periphery of the fixing belt 11 is in contact with a pressure roller 12 which is a pressure member.

The pressure roller 12 forms a fixing nip portion N through the fixing belt 11 together with the belt guide 13. In the fixing nip portion N, the recording material P which bears an unfixed toner image is heated while conveyed to fix the unfixed toner image on the recording material P. Note that a thermistor 18 used as a temperature detecting member for detecting a temperature in a sheet-passing area of the recording material P abuts on the inner periphery of the fixing belt 11 to control a temperature of the fixing belt 11.

In this exemplary embodiment, the belt guide 13, while sandwiching the fixing belt 11 between it and the pressure roller 12, is pressed against the pressure roller 12 through the flange 14 by a pressure spring 15 which is a compression spring, at a force of about 118 N (about 12 Kgf) in total pressure. Also, the pressure roller 12 is driven by a pressure roller drive gear to rotate counterclockwise as shown by the arrow in FIG. 3. This rotation of the pressure roller 12 applies a force to the fixing belt 11 in the fixing nip portion, and the fixing belt 11 is accordingly driven to rotate.

(Fixing Belt)

Figure 4:
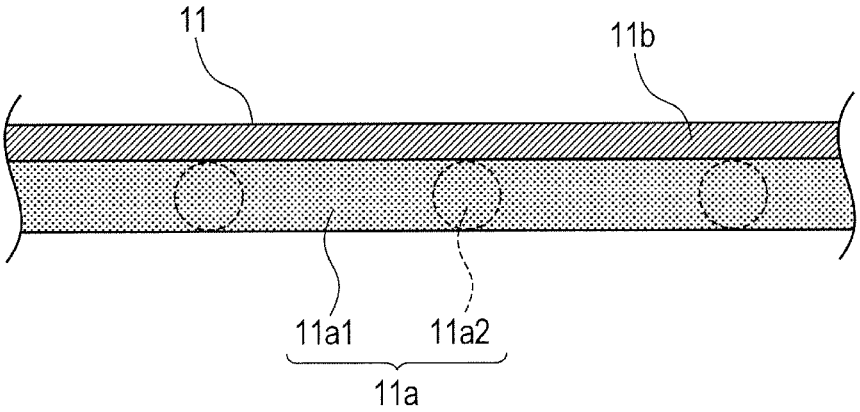
FIG. 4 illustrates a layer configuration of the heat generating layer of a fixing belt in a cross-sectional view.

Then, a fixing belt according to this exemplary embodiment will be described with reference to FIGS. 2 and 4. The cylindrical fixing belt 11 is loosely fitted outside of a belt guide 13 described later, and has an excess peripheral length. Referring to FIG. 4, a configuration of the fixing belt 11 will be described in detail. FIG. 4 illustrates a layer configuration of a heat generating layer of the fixing belt in a cross-sectional view.

The fixing belt 11, as shown in FIG. 4, has a cylindrical heat generating layer 11*a* which is electrified to generate heat. The heat generating layer 11*a* has a resin material 11*a*1 and an electrically conductive filler 11*a*2 dispersed in the resin material 11*a*1. The resin material 11*a*1 is formed of a heat resistant resin such as polyimide, polyamideimide, polyether ether ketone (PEEK), polyether sulfone (PES), and polyphenylene sulfide (PPS). The electrically conductive filler 11*a*2 has an anisotropic shape and the longitudinal direction thereof oriented in a peripheral direction of the belt. For the electrically conductive filler, a carbon nanomaterial such as carbon nanofiber, carbon nanotube and carbon microcoil, and a metal microparticle or a metal oxide microparticle are used.

A proportion of the electrically conductive filler to the resin material 11*a*1 may be 30 to 60% by weight percentage. Note that the heat generating layer used in this exemplary embodiment is formed by dispersing carbon nanotube having a length of 150 μm in polyimide. In FIG. 4, the electrically conductive filler 11*a*2 is dispersed in the resin material and exists in the heat generating layer in a random manner. However, the electrically conductive filler has the longitudinal axis thereof oriented in the peripheral direction of the belt.

In the fixing belt 11 in this exemplary embodiment, since the electrically conductive filler is oriented in the peripheral direction of the belt, anisotropy can be imparted to sheet resistance ohm/square of the resistive heat generating layer 11*a*. That is, let sheet resistance (surface resistance) of the heat generating layer 11*a* in the longitudinal direction be R1, and sheet resistance (surface resistance) of the heat generating layer 11*a* in the peripheral direction be R2, the relation of R1>R2 can hold. Therefore, the electrical sheet resistance R1 of the heat generating layer 11*a* in the longitudinal direction is larger than the sheet resistance R2 of the heat generating layer 11*a* in the peripheral direction. Note that a proportion between the sheet resistances R1 and R2 may be determined from the measurement result, as described below.

That is, the belt is cut open in a generatrix direction in a part of the peripheral direction of the belt 11 to be formed in a rectangular sheet, and further, the long side of the rectangular sheet is cut to have an equal length to that of the short side, forming a square shape. Then, on the two opposing sides of the square, terminals for measuring a resistance value are attached to measure (there are two sets of the opposing sides, and each of them is intended for measurement). A method for orienting the electrically conductive filler (dispersed material) in the peripheral direction of the heat generating layer 11*a* includes, for example, a method in which a cylindrical mold while rotating is beam-coated with a polyimide precursor solution having an electrically conductive filler dispersed therein.

In addition, if the image forming apparatus is operated using a commercial power, electric power applied to the fixing belt 11 may be 100 W to 1500 W, considering a power supply capacity, a printing speed, and a start-up time of the fixing apparatus. Accordingly, a resistance value measured between both ends of the heat generating layer 11*a* in the longitudinal direction (the direction of the axis of rotation) (that is, between feeding electrodes) may be in the range of 5Ω to 100Ω. Also, the heat generating layer 11*a* may be 30 to 200 μm in thickness, considering the range of the resistance value (5Ω to 100Ω) and strength of the fixing belt 11.

On the outer periphery of the heat generating layer 11*a*, a release layer 11*b* (surface release layer) (FIG. 4) is provided to ensure releasability from a toner image T (FIG. 4) which the recording material P bears. The release layer 11*b* is formed of a heat resistant fluorine resin, such as polytetrafluoroethylene (PTFE), tetrafluoroethylene-perfluoroalkylvinylether copolymer (PFA), and tetrafluoroethylene-hexafluoropropylene copolymer (FEP). And, the release layer 11*b* is bonded to the outer periphery of the heat generating layer 11*a* through a primer layer (not shown). In this release layer 11*b*, carbon or electrical resistance control substance having ion conductive property (organophosphorous acid, antimony pentoxide, titanic oxide) may be dispersed.

(Electrode Member)

As shown in FIGS. 1A and 1B, electrode members 16 (electrical contact portion) for supplying electric power to the heat generating layer 11*a* are connected in areas 11*a*R, 11*a*L (hereinafter, called a "power supply area") outside of a sheet-passing area in both ends of this heat generating layer 11*a* in the longitudinal direction, at predetermined positions of the heat generating layer 11*a* in the peripheral direction. The power supply areas 11*a*R, 11*a*L of the heat generating layer 11*a* may be coated with an electrically conductive material such as Ag.

Figure 5:
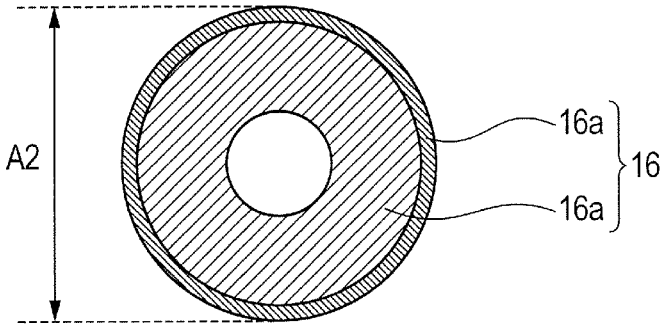
FIG. 5 illustrates a configuration of an electrical contact portion according to a first exemplary embodiment in a cross-sectional view.

A configuration of the electrode member 16 will be described with reference to FIG. 5. FIG. 5 schematically illustrates the electrode member 16 in a cross-sectional view. The electrode member 16 is provided on a metal core 12*a* of the pressure roller 12 and the electrode member 16 includes an elastic layer 16*b* formed of insulating silicone rubber and disposed coaxially with the pressure roller 12, and an electrically conductive layer formed by coating the outside of the elastic layer 16*b* with an electrically conductive material 16*a* such as Ag. Also, the elastic layer 16*b* has a hollow central portion, which is fitted to a metal core 12*a* of the pressure roller 12. Also, as shown in FIGS. 1A and 1B, the magnitude relation between a diameter A2 of the electrode member 16 and a diameter A1 of the pressure roller 12 is A2>A1. In addition, this electrode member 16 is fed from an AC power supply through a sliding contact 21.

(Belt Guide Used as Nip Portion Forming Member)

The belt guide 13 is formed using a high heat resistive resin such as polyimide, polyamideimide, polyether ether ketone (PEEK), polyphenylene sulfide (PPS) and liquid crystal polymer, and a composite material such as any combinations of these resins with ceramics, metal and glass. In this exemplary embodiment, liquid crystal polymer was used as a material of the belt guide 13. This belt guide 13 is configured so that both ends of the belt guide 13 in the longitudinal direction are supported on a unit flame of the fixing apparatus 7 through the flanges 14R, 14L.

(Pressure Roller)

The pressure roller 12 includes, as shown in FIG. 2, a metal core 12*a*, an elastic body layer 12*b* provided on an outer periphery of the metal core 12*a*, and a release layer 12*c* which is the outermost layer provided on an outer periphery of the elastic body layer 12*b*. In this exemplary embodiment, for the metal core 12*a*, an aluminum metal core was used, for the elastic body layer 12*b*, silicone rubber was used, and the release layer 12*c* was formed by coating coatetrafluoroethylene-perfluoroalkylvinylether copolymer (PFA). The pressure roller 12 is disposed below and parallel to the fixing belt 11, and both ends of the metal core 12*a* in the longitudinal direction are rotatably supported on the unit flame through a bearing (not shown).

(Operation of Fixing Apparatus for Predetermined Period from Start of Warm-Up and for Period to Heat Toner Image)

Referring to FIGS. 1A and 1B, a description will be provided about a predetermined period from the start of warming up the fixing apparatus which is a previous stage to a period to heat a toner image. The phrase "predetermined period from the start of warm-up", as used herein, means a period in which the fixing belt is forced to generate heat after a print signal is received until a temperature of the fixing belt reaches a predetermined temperature. The phrase "period to heat a toner image" is a period to convey and heat the recording material which bears a toner image in the fixing nip portion N. First, as shown in FIG. 1A, for the predetermined period from the start of warming up the fixing apparatus after the print signal is transmitted, the fixing belt 11 and the pressure roller 12 are not in contact with each other, except for contact portions outside of the sheet-passing area on the sides of both ends in the longitudinal direction (spaced apart state). That is, as shown in FIGS. 1A and 1B, in the sheet-passing area, a pressure control device 200 prevents a pressure applied by a pressure device 100, and the pressure spring 15 is released from compression, resulting in a decreased pressure applied to the flange 14 by the pressure spring 15.

Even if the fixing belt 11 and the pressure roller 12 are spaced apart from each other in the sheet-passing area, the electrode members 16 provided in both ends of the fixing belt and the pressure roller are in contact with the power supply areas 11*a*L, 11*a*R in both ends of the fixing belt in the longitudinal direction. It is because the diameter A2 of the electrode members 16 is larger than the diameter A1 of the pressure roller 12, and the electrode members 16 are in contact with the power supply areas 11*a*L, 11*a*R, with the elastic layer thereof being forced to be elastically deformed.

The electrode members 16 are in contact with the heat generating layer 11*a* (power supply area) for all of the predetermined period from the start of warm-up, a period from the completion of the predetermined period to the start of the period to heat a toner image, and the period to heat a toner image, and the AC power supply can feed the heat generating layer 11*a* of the fixing belt through the sliding contact 21.

Further, for the period from the completion of the predetermined period from the start of warm-up to the start of the period to heat a toner image, a contact area of the belt with the pressure roller is made equal to the contact area for the period to heat a toner image, and the belt is rotated, subsequently the recording material is introduced into the fixing nip portion.

(Arrangement of Belt Guide Relative to Fixing Belt for Predetermined Period from Start of Warm-Up)

The fixing belt 11 and the belt guide 13 are also spaced apart from each other in the sheet-passing area, but outside of the sheet-passing area, they are in contact with each other. The details will be described with reference to FIG. 1B. FIG. 1B schematically illustrates an enlarged area shown by the dotted line B in FIG. 1A in a longitudinal sectional view. The belt guide 13 has a depressed portion at a position opposing to the electrode member 16, and into this depressed portion, an elastic member 17 (first elastic member) is inserted.

When the pressure spring 15 is released from compression through the elastic member 17 by the pressure control device 200 working as a pressure release mechanism, only the fixing belt 11 and the elastic member 17 are in contact with each other, and in other areas in the longitudinal direction, the fixing belt 11 and the belt guide 13 are spaced apart from each other. For the predetermined period from the start of warm-up, the contact area of the fixing belt with the belt guide decreases relative to the contact area for the period to heat a toner image. That is, the fixing belt and the belt guide spaced apart from each other in the sheet-passing area are in contact with each other only in the areas opposing to the elastic members 17 on the sides of both ends of the fixing belt outside of the sheet-passing area.

For the period to heat a toner image, the pressure applied by the pressure spring 15 forces the elastic member 17 to be elastically deformed, so that the belt guide 13 and the fixing belt 11 are brought into contact with each other over the entire area in the longitudinal direction.

Note that for the predetermined period from the start of warm-up, the fixing belt and the belt guide can be spaced apart from each other using a detachment device 300 over the entire area including the outside of the sheet-passing area.

(Heating and Fixing Operations)

Figure 6:
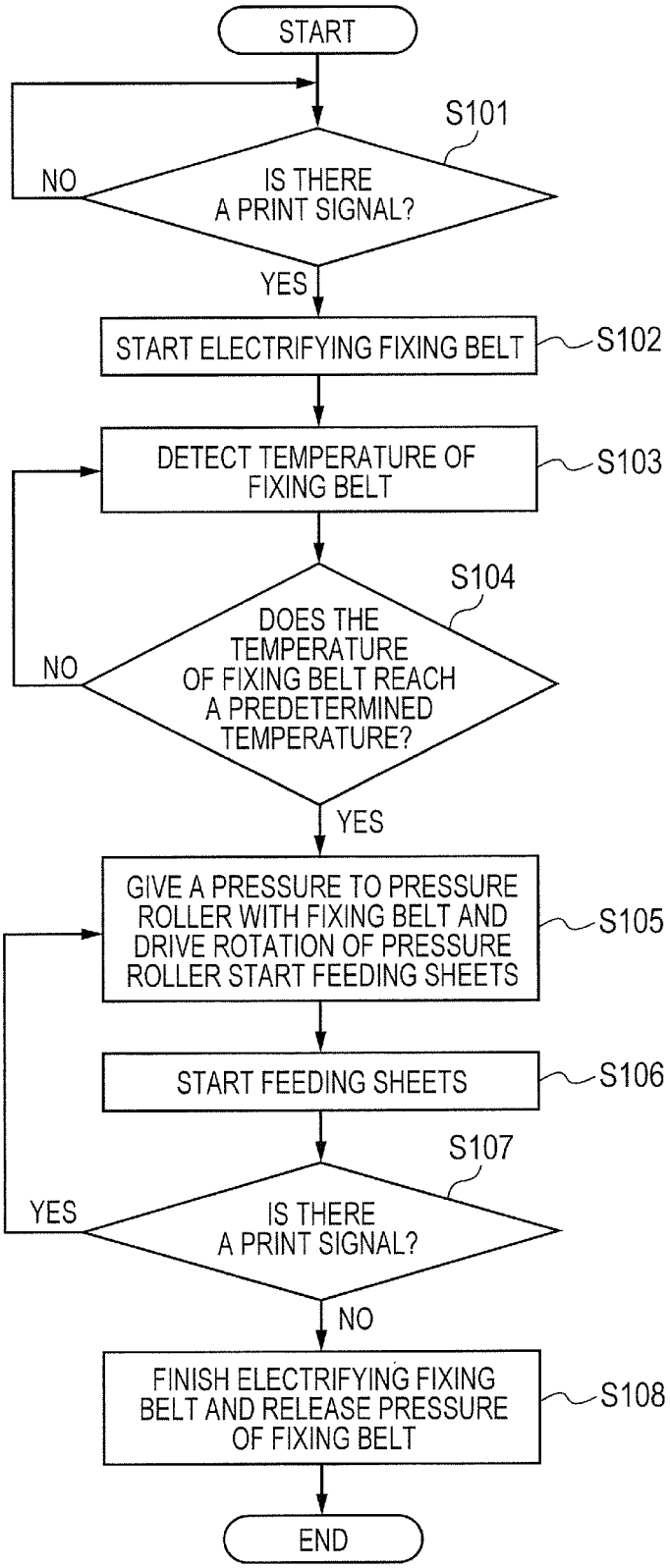
FIG. 6 is a flowchart illustrating operations of a fixing apparatus according to the first exemplary embodiment.

Next, heating and fixing operations of the fixing apparatus will be described with reference to a flowchart in FIG. 6. When the controller receives a print command at S101, the AC power supply begins to electrify the heat generating layer 11*a* of the fixing belt 11 through the electrode members 16 (S102). Accordingly, the heat generating layer 11*a* generates heat over the entire circumference, and the fixing belt 11 rapidly rises in temperature. The temperature of the fixing belt 11 is detected by a temperature detecting member 18 such as a thermistor disposed in contact with or near the inner surface of the heat generating layer 11*a* (S103). This temperature detecting member 18 is supported on the unit flame or the belt guide through a predetermined bracket.

When it is detected at S104 that the temperature of the fixing belt 11 reaches a predefined and predetermined temperature, then the process proceeds to S105. At S105, the pressure spring 15 is compressed to press the fixing belt against the pressure roller. At this time, the elastically deformable electrode members 16 are elastically deformed due to the pressure applied to the fixing belt 11, and the fixing belt accordingly abuts against the pressure roller. Also, at S105, at the same time, a motor M shown in FIG. 2 is driven to rotate. The rotation of an output shaft of the motor M is transmitted to the metal core 12*a* of the pressure roller 12 through a predetermined gear train (not shown). Accordingly, the pressure roller 12 is driven to rotate at a predetermined peripheral speed (process speed) counterclockwise as shown by the arrow.

The rotation of the pressure roller 12 is transmitted to the fixing belt 11 by a frictional force produced between the surface of the pressure roller 12 and the surface of the fixing belt 11 in the fixing nip portion N. Accordingly, the rotation of the pressure roller 12 drives the fixing belt 11 to rotate while the inner periphery (inner surface) of the heat generating layer 11*a* of the fixing belt 11 is in contact with the outer periphery of the belt guide 13. While the motor M is driven to rotate and the heat generating layer 11*a* is electrified, the recording material P which bears an unfixed toner image T is introduced into the fixing nip portion N, with its plane which bears the toner image upward (S106).

This recording material P is sandwiched between the surface of the fixing belt 11 and the surface of the pressure roller 12, and conveyed in the fixing nip portion N. In this conveyance process, the toner image T on the recording material P is heated by the fixing belt 11 and melts, and then the toner image is pressed in the fixing nip portion N to be fixed under heat on the recording material P. And, the recording material P on which the toner image T is fixed under heat is conveyed from the fixing nip portion N to a recording material ejection mechanism. At this time, the controller takes in an output signal from the temperature detecting member 18 (temperature detection signal), and based on this signal, controls the electrical power so that the fixing belt 11 can maintain the predetermined fixing temperature (target temperature).

Next, if the print signal subsequently comes, the processing at S106 is repeated, and if there is no print signal, the process proceeds to S108 to stop electrifying the fixing belt and applying the pressure to the fixing belt.

(Comparison with Comparative Examples)

The fixing apparatus in this exemplary embodiment is viewed as an example 1 and an example 2, and a fixing apparatus for comparative study is viewed as a comparative example 1 and a comparative example 2, and comparison study on them will be described. The fixing belt has all the same components in the example 1, the example 2, the comparative example 1 and the comparative example 2, and includes, as shown in FIG. 4, a two-layer configuration composed of the heat generating layer 11*a* and the release layer 11*b*. For the heat generating layer 11*a*, polyimide having the thickness of 60 μm was used. Further, for the electrically conductive filler to be dispersed in the heat generating layer 11*a*, carbon nanofiber (150 μm in length) was used. The carbon nanofiber has its longitudinal axis oriented in the peripheral direction of the belt.

A proportion of the electrically conductive filler (carbon nanofiber) to the resin material 11*a*1 formed of polyimide is 40% by weight. In this heat generating layer 11*a*, a ratio of sheet resistance R1 in the longitudinal direction to sheet resistance R2 in the peripheral direction was 1.6:1. For the release layer 11*b*, PFA having the thickness of 10 μm is coated on the outer periphery of the heat generating layer 11*a*. The fixing belt has ϕ 24 mm in inner diameter, and 230 mm in length. The power supply areas 11*a*R, 11*a*L of the both ends of the heat generating layer 11*a* in the longitudinal direction, except for the release layer 11*b*, are coated with Ag. The resistance value measured between both ends of the heat generating layer 11*a* of the fixing belt in the longitudinal direction was 15Ω.

The pressure roller includes also all the same components in the example 1, the example 2, the comparative example 1 and the comparative example 2, and has ϕ 25 mm in outer diameter. And, the elastic layer was formed of silicone rubber on the outer periphery of the metal core of aluminum, and the outer periphery of this elastic layer was coated with a PFA resin to form the release layer.

<Comparison of Warm-Up Time>

In heating and fixing operations according to the example 1, for the predetermined period from the start of warm-up, the fixing belt and the pressure roller are not in contact with each other, and the fixing belt and the belt guide are also not in contact with each other, and further the pressure roller is not rotating. Under these conditions, the fixing belt is supplied with a fixed electric power of 800 W, and when the temperature detecting element disposed on the inner surface of the fixing belt senses the temperature of 180° C., then a pressure of 118 N is applied so that the contact area of the belt guide with the fixing belt and the contact area of the fixing belt with the pressure roller are equal to those for the period to heat a toner image. At the same time, the pressure roller is driven to rotate.

Also, in heating and fixing operations according to the example 2, for the predetermined period from the start of warm-up, the belt guide and the pressure roller are pressed under a weak pressure of 50 N so that the contact area of the fixing belt with the pressure roller is smaller than the contact area for the period to heat a toner image. Under this condition, the fixing belt is supplied with a fixed electric power of 800 W, and when the temperature detecting element disposed on the inner surface of the fixing belt senses the temperature of 180° C., then a pressure of 118 N is applied so that the contact area of the belt guide with the fixing belt and the contact area of the fixing belt with the pressure roller are equal to those for the period to heat a toner image. At the same time, the pressure roller is driven to rotate.

On the other hand, in heating and fixing operations according to the comparative example 1, for the predetermined period from the start of warm-up, the contact area of the fixing belt with the pressure roller is equal to the contact area for the period to heat a toner image. Also, the contact area of the fixing belt with the belt guide is equal to the contact area for the period to heat a toner image. Under these conditions, the fixing belt is supplied with a fixed electric power of 800 W, and when the temperature detecting element disposed on the inner surface of the fixing belt senses the temperature of 180° C., the pressure roller is driven to rotate.

Also, in heating and fixing operations according to the comparative example 2, for the predetermined period from the start of warm-up, the contact area of the fixing belt with the pressure roller is equal to the contact area for the period to heat a toner image. Also, the contact area of the fixing belt with the belt guide is equal to the contact area for the period to heat a toner image. Under these conditions, the fixing belt is supplied with a fixed electric power of 800 W, and at the same time, the pressure roller is driven to rotate.

Note that the fixing apparatuses according to the examples 1 and 2, and the comparative examples 1 and 2 have the sheet resistance R1 of the heat generating layer 11*a* in the peripheral direction lower than the sheet resistance R2 of the heat generating layer 11*a* in the longitudinal direction. Accordingly, if the heat generating layer 11*a* is electrified from both ends of the heat generating layer 11*a* in the longitudinal direction through the electrode members 16, a current flowing in the heat generating layer 11*a* has a tendency to flow around in the peripheral direction, so that a distribution of generated heat is uniformed in the peripheral direction. As the result, even if the heat generating layer 11*a* is electrified when the fixing belt is not rotating, the fixing belt can generate heat uniformly over the entire circumference.

Under the conditions described above, each of the fixing apparatuses was warmed up, and after a predetermined time elapsed from the start of electrification, the recording material which bore an unfixed toner image was introduced into the fixing nip portion to verify whether poor fixing was present or not. The result is shown in table 1.

TABLE 1

| | Time period from start of electrification to introduction of recording material | | | |
|---|---|---|---|---|
| | 1.5 sec. | 1.8 sec. | 2.5 sec. | 4 sec. |
| Example 1 | Absence of poor fixing | Absence of poor fixing | Absence of poor fixing | Absence of poor fixing |
| Example 2 | Presence of poor fixing | Absence of poor fixing | Absence of poor fixing | Absence of poor fixing |
| Comparative example 1 | Presence of poor fixing | Presence of poor fixing | Absence of poor fixing | Absence of poor fixing |
| Comparative example 2 | Presence of poor fixing | Presence of poor fixing | Presence of poor fixing | Absence of poor fixing |

In the case of the comparative example 2, for the predetermined period from the start of warm-up, while the contact area of the fixing belt with the pressure roller and the contact area of the fixing belt with the belt guide are equal to those for the period to heat a toner image in the sheet-passing area, the pressure roller is driven to rotate, thereby the fixing belt is driven to rotate. Accordingly, the heat is easily conducted from the fixing belt to the pressure roller and the belt guide in the fixing nip portion. Furthermore, because the rotation of the fixing belt and the pressure roller caused the heat to be conducted from the fixing belt to the entire surface of the pressure roller, the fixing belt rose slowly in temperature, leading to occurrence of poor fixing even if the recording material was fed after 2.5 sec. elapsed from the start of electrification.

Next, in the case of the comparative example 1, for the predetermined period from the start of warm-up, the contact area of the fixing belt with the pressure roller and the contact area of the fixing belt with the belt guide are similar to the comparative example 2. However, because the fixing belt was not rotating, the fixing belt rose more rapidly in temperature than in the case of the comparative example 2. Poor fixing did not occur if the recording material was fed after 2.5 sec. elapsed from the start of electrification. However, unevenness in fixable property occurred with a period of the circumference of the fixing belt if the recording material was fed after 1.8 sec. elapsed, and it was determined to be poor fixing.

Next, the comparative example 2 differs from the comparative example 1 in that for the predetermined period from the start of warm-up, while the contact area of the fixing belt with the pressure roller and the contact area of the fixing belt with the belt guide in the sheet-passing area are decreased relative to those for the period to heat a toner image (in a weak pressure applied state), the fixing belt is electrified.

In the case of the example 2, for the predetermined period from the start of warm-up, the heat conduction from the fixing belt to the pressure roller and the belt guide is not likely to occur compared with the case of the comparative example 1. Accordingly, the fixing belt more rapidly rose in temperature than in the case of the comparative example 1. Poor fixing did not occur even if the recording material was fed after 1.8 sec. elapsed from the start of electrification. However, poor fixing began to appear when the recording material was fed after 1.5 sec. elapsed.

In the case of the example 1, for the predetermined period from the start of warm-up, in the sheet-passing area, the fixing belt and the pressure roller are not in contact with each other and the fixing belt and the belt guide are not in contact with each other. For the predetermined period from the start of warm-up, the fixing belt was not deprived of a large quantity of heat due to heat conduction, and the fixing belt could generate heat, so that poor fixing did not occur even if the recording material was fed after 1.5 sec. elapsed from the start of electrification.

Therefore, from the foregoing, in this exemplary embodiment, for the predetermined period from the start of warm-up, while the contact area of the fixing belt with the pressure roller and the contact area of the fixing belt with the belt guide are decreased relative to those for the period to heat a toner image, the fixing belt is electrified, thereby allowing the fixing belt to rise more rapidly in temperature. Also, in this exemplary embodiment, the fixing belt can be at once spaced apart/contacted from/with the pressure roller and from/with the belt guide by integrally stretching or compressing the respective elastic members disposed between the fixing belt and the pressure roller and between the fixing belt and the belt guide. Further, by providing respectively simple elastic members at a position of both ends of the fixing belt and the pressure roller between them and at a position of both ends of the fixing belt and the belt guide between them, the operation for the predetermined period from the start of warming up the fixing apparatus can be stably achieved in an easy manner.

Note that the fixing belt used in this exemplary embodiment has the two-layer configuration including the heat generating layer and the release layer (surface layer), but it may have an elastic layer as an intermediate layer, the elastic layer consisting of silicone rubber or the like and disposed between the heat generating layer and the release layer. Further, without imparting anisotropy to the shape of the filler dispersed in the electrified heat generating layer of the fixing belt, the similar effect can be achieved.

Furthermore, if the fixing belt generates heat over the entire circumference for the predetermined period from the start of warm-up, the fixing belt needs not to be rotated when the fixing belt and the pressure roller are spaced apart from each other. Accordingly, the fixing belt needs not to have a larger rigidity, and a thin fixing belt having a small heat capacity can accordingly be used. As the result, a configuration can be provided in which the warm-up period can be advantageously shortened. Also, the fixing belt may not be rotated for the predetermined period from the start of warm-up, which can give the fixing belt a long life.

It was described that the predetermined period from the start of warm-up is the period until the temperature of the temperature detecting member for detecting the temperature of the fixing belt reaches the predetermined temperature, but the predetermined period may be a period until a predetermined time elapses from the start of warm-up.

Figure 7A:
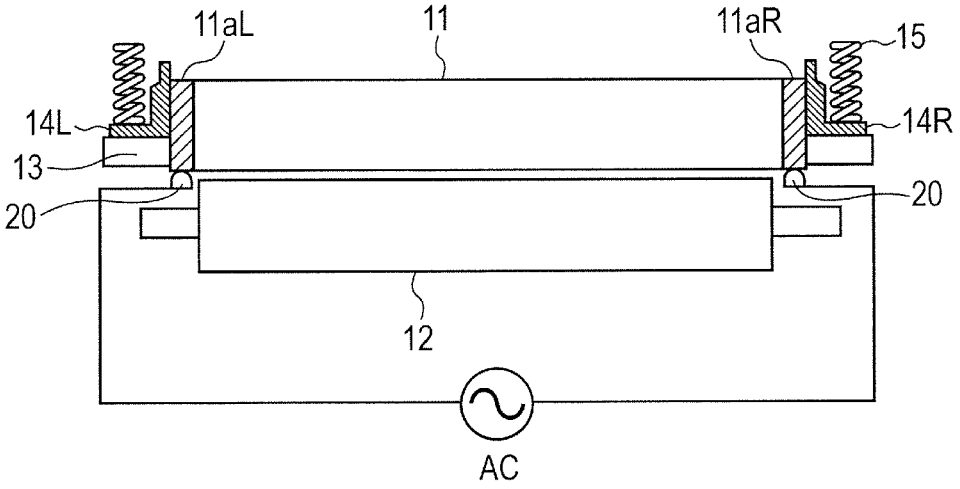
FIG. 7A schematically illustrates a fixing apparatus according to a second exemplary embodiment in a vertical-sectional view.
Figure 7B:
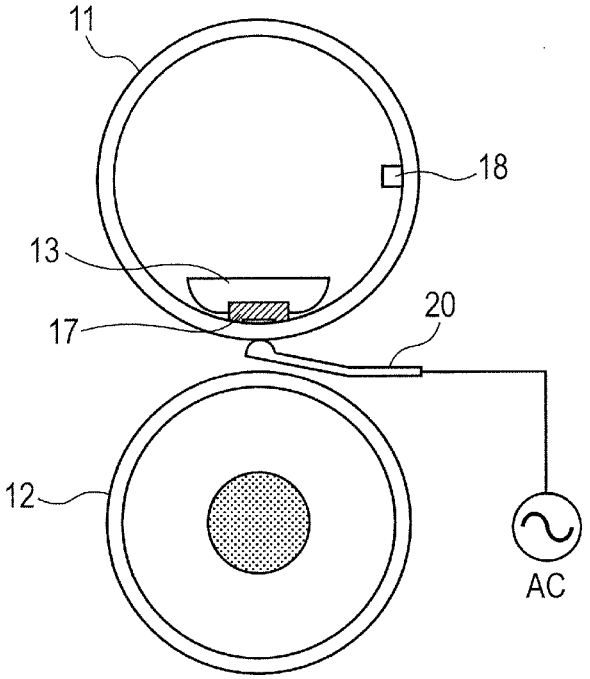
FIG. 7B schematically illustrates the fixing apparatus according to the second exemplary embodiment in a cross-sectional view.

A second exemplary embodiment will be described. Hereinafter, the second exemplary embodiment of the present invention will be described with reference to FIGS. 7A and 7B. This exemplary embodiment differs from the first exemplary embodiment in that a leaf spring is used as the electrical contact portion member, and has configurations of the fixing belt 11 and the pressure roller 12 similar to the first exemplary embodiment, and repeated description will accordingly be omitted. Also, to components and parts similar to the first exemplary embodiment, similar symbols are assigned. FIG. 7A schematically illustrates a main portion of a fixing apparatus in the longitudinal direction. FIG. 7B is a schematic cross-sectional view, including a electrical contact portion. In addition, FIGS. 7A and 7B illustrate a standby state at start of the fixing apparatus, and the pressure spring 15 is released from compression by the pressure control device 200 (FIG. 1A) used as a pressure release mechanism. Accordingly, the fixing belt 11 and the pressure roller 12 are spaced apart from each other in the sheet-passing area.

In this exemplary embodiment, a method for feeding the heat generating layer 11*a* of the fixing belt 11 includes sliding and pressing leaf springs 20 shown in FIG. 7B. The leaf springs 20 are disposed at positions abutting against outer surfaces of the power supply areas 11*a*l, 11*a*R in both ends of the fixing belt shown in FIG. 7A (outside of the sheet-passing area). Also, as shown in FIG. 7B, a direction in which the leaf spring 20 applies a pressure is a direction opposing to the belt guide 13, and an opposing direction to a direction in which the fixing belt 11 applies a pressure to the pressure roller 12 using the pressure spring 15.

Further, while the fixing belt 11 is pressed against the pressure roller 12, the strength of the spring pressure of the pressure spring 15 is set to be larger than that of the leaf spring 20. Also, an end of the leaf spring 20 on the side opposing to an end abutting against the fixing belt 11 is fixedly supported on an unshown flame of the fixing apparatus through an insulating layer.

Furthermore, for the predetermined period from the start of warm-up, while the pressure is not applied by the pressure spring 15, the fixing belt 11 and the pressure roller are spaced apart from each other because the leaf spring 20 presses the fixing belt 11 in a direction in which the fixing belt 11 and the pressure roller 12 are spaced apart from each other. Further, similarly to the first exemplary embodiment, the fixing belt 11 abuts against elastic members 17 disposed in both ends of the belt guide 13 shown in FIG. 7B (outside of the sheet-passing area), and the fixing belt 11 and the belt guide 13 are spaced apart from each other.

(Heating and Fixing Operations of Fixing Apparatus)

When the controller receives a print command, the AC power supply begins to electrify the heat generating layer 11*a* of the fixing belt 11 through the leaf spring 20. This causes the heat generating layer 11*a* to generate heat, and the fixing belt 11 then rises rapidly in temperature. The temperature of the fixing belt 11 is detected by the temperature detecting member 18 such as a thermistor disposed in contact with or near the inner surface of the heat generating layer 11*a*. When it is detected that the temperature of the fixing belt 11 reaches the predetermined temperature, the pressure spring 15 is compressed to press the fixing belt against the pressure roller.

At this time, the leaf spring 20 is pressed by the fixing belt 11 to be elastically deformed, and the fixing belt accordingly abuts against the pressure roller. Further, at the same instant, the pressure roller 12 is driven to rotate. The rotation of the pressure roller 12 is transmitted to the fixing belt 11 due to a frictional force generated between the surface of the pressure roller 12 and the surface of the fixing belt 11 in the fixing nip portion N. This forces the fixing belt 11 to be driven to rotate following the rotation of the pressure roller 12, with the inner periphery (inner surface) of the heat generating layer 11*a* of the fixing belt 11 being in contact with the outer periphery of the belt guide 13. While the heat generating layer 11*a* is electrified, the recording material P which bears an unfixed toner image T is introduced into the fixing nip portion N, with the surface on which bears the toner image upward.

This recording material P is sandwiched between the surface of the fixing belt 11 and the surface of the pressure roller 12 and conveyed in the fixing nip portion N. In this conveyance process, the toner image T on the recording material P is heated by the fixing belt 11 and melts, and the toner image T is then pressed in the fixing nip portion N to be fixed under heat on the recording material P. Subsequently, the recording material P on which the toner image T is fixed under heat is conveyed from the fixing nip portion N to the recording material ejection mechanism. At this time, the controller takes in an output signal (temperature detecting signal) from the temperature detecting member 18, and based on this output signal, controls the electrical power so that the fixing belt 11 can maintain a predetermined fixing temperature (target temperature).

From the foregoing, also in this exemplary embodiment, the similar effect to the first exemplary embodiment can be achieved.

Other Exemplary Embodiment

The fixing apparatus for fixing under heat an unfixed toner image on a recording material has been described above, but the present invention is not limited to this. That is, for example, this fixing apparatus can be used as an apparatus for heating and temporarily fixing an unfixed toner image on a recording material, or as an apparatus for heating a toner image already fixed under heat on a recording material to impart glazing to a surface of the toner image.

Further, in the first and second exemplary embodiment, the fixing belt which generates heat from electrification has been described as a fixing belt. A fixing apparatus in the form of induction heat generation can be also used, which fixing apparatus generates heat in a manner that a fixing belt having an electrically conductive layer and an exciting coil are provided to form an electromagnetic field, and the electromagnetic field produces eddy currents over the entire circumference of the fixing belt, which causes the fixing belt to generate heat. Furthermore, for the predetermined period from the start of warm-up, the fixing belt remaining at rest can be used.

Note that the pressure control device 200 and the detachment device 300 are not limited to the foregoing, and the operation for spacing apart may be performed in a manner that for the predetermined period from the start of warm-up, the ends of the belt guide and the pressure roller are moved obliquely relative to the fixing belt by using the other ends of them in the longitudinal direction as a supporting point.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-166701, filed Jul. 29, 2011, which is hereby incorporated by reference herein in its entirety.

What is claimed is:

1. An image heating apparatus for conveying a recording material which bears a toner image by a nip portion and heating the toner image, comprising:

a tubular belt including a heat generating layer extending along the entire circumference of the tubular belt;

a nip portion forming member that contacts an inner surface of said belt; and a pressure roller that forms said nip portion together with said nip portion forming member via the belt, said pressure roller being driven by a driving source and driving the belt to rotate in the nip portion, wherein the heat generating layer is configured to generate heat along the entire circumference of the tubular belt in response to the flow of current along the entire circumference of the heat generating layer regardless of a rotation of the tubular belt, and wherein in the image heating apparatus for a predetermined period from the start of warming up the image heating apparatus, a contact area between said belt and the pressure roller is smaller than a contact area for a period to heat a toner image, or said belt does not contact said pressure roller, and said belt stops rotating.

2. The image heating apparatus according to claim 1, wherein an electrical contact portion that is elastically deformable is provided on a metal core of said pressure roller, and wherein a power is supplied to the heat generating layer through the electrical contact portion, and wherein the electrical contact portion contacts the non-sheet-passing area of an end of the heat generating layer in the longitudinal direction for the predetermined period, for the period from the completion of the predetermined period to the start of the period to heat a toner image, and for the period to heat a toner image.

3. The image heating apparatus according to claim 2, wherein said electrical contact portion includes an elastic layer formed coaxially with the pressure roller and an electrically conductive surface layer formed outside of the elastic layer, and has a larger outer diameter than that of the pressure roller.

4. The image heating apparatus according to claim 3, wherein the elastic layer is formed of insulating silicone rubber.

5. The image heating apparatus according to claim 3, wherein the electrically conductive surface layer is formed by coating silver on the outside of the elastic layer.

6. The image heating apparatus according to claim 1, wherein a surface resistance value of the heat generating layer in the peripheral direction of the belt is lower than that of the heat generating layer in the longitudinal direction of the belt.

7. The image heating apparatus according to claim 1, wherein the image heating apparatus includes a temperature detecting member configured to detect a temperature of said belt, and the predetermined period is a period until a temperature detected by the temperature detecting member reaches a predetermined temperature.

8. The image heating apparatus according to claim 1, wherein said image heating apparatus includes a belt unit in which said belt and said nip portion forming member are assembled, and wherein said belt unit is movable in a direction away from said pressure roller.

9. An image heating apparatus for heating an toner image formed on a recording material while conveying the recording material at a nip portion, comprising:

a rotating member configured to contact the toner image, the rotating member including a heat generating layer extending along the entire circumference of the rotating member; and a back-up member configured to contact the rotating member and form the nip portion between itself and the rotating member, wherein the heat generating layer is configured to generate heat along the entire circumference of the rotating member in response to the flow of current along the entire circumference of the heat generating layer regardless of a rotation of the rotating member, and wherein an area of the nip portion for a predetermined period from a start of warming up the image heating apparatus is smaller than the area of the nip portion for a period to heat the toner image, or the rotating member does not contact the back-up member for the predetermined period from the start of warming up the image heating apparatus.

10. The image heating apparatus according to claim 9, wherein the rotating member stops rotating for the predetermined period from the start of warming up the image heating apparatus.

11. The image heating apparatus according to claim 9, wherein the rotating member is a first rotating member and the back-up member is a second rotating member driven by a driving source, and wherein the first rotating member rotates by following a rotation of the second rotating member.

12. The image heating apparatus according to claim 9, wherein the rotating member is a belt.

13. The image heating apparatus according to claim 12, further comprising a nip forming member contacting an inner surface of the belt and forming the nip portion with the back-up member via the belt.

14. The image heating apparatus according to claim 9, wherein the heat generating layer generates heat by electromagnetic induction.

15. The image heating apparatus according to claim 9, wherein the back-up member is a roller, and wherein the roller is driven by a driving source and the rotating member is driven by a rotation of the roller.

16. An image heating apparatus for heating a toner image formed on a recording material while conveying the recording material at a nip portion, comprising:

a rotating member configured to contact the toner image, the rotating member including a heat generating layer extending along the entire circumference of the rotating member; and a back-up member configured to contact the rotating member and form the nip portion between itself and the rotating member, wherein the heat generating layer is configured to generate heat along the entire circumference of the rotating member in response to the flow of current along the entire circumference of the heat generating layer regardless of a rotation of the rotating member, and wherein the rotating member stops rotating for a predetermined period from a start of warming up the image heating apparatus.

17. The image heating apparatus according to claim 16, wherein the rotating member is a belt.

18. The image heating apparatus according to claim 16, further comprising a nip forming member configured to contact an inner surface of the belt and forming the nip portion with the back-up member via the belt.

19. The image heating apparatus according to claim 16, wherein the back-up member is a rotating member.

20. The image heating apparatus according to claim 16, wherein the heat generating layer generates heat by electromagnetic induction.

21. The image heating apparatus according to claim 16, wherein the back-up member is a roller, and wherein the roller is driven by a driving source and the rotating member is driven by a rotation of the roller.

22. An image heating apparatus for heating a toner image formed on a recording material while conveying the recording material at a nip portion, comprising:

a rotating member configured to contact the toner image, the rotating member including a heat generating layer; and a back-up member configured to contact the rotating member and form the nip portion between itself and the rotating member, wherein the entire circumference of the rotating member is heated by a current flowing into the heat generating layer, regardless of a rotation of the rotating member, and wherein an area of the nip portion for a predetermined period from a start of warming up the image heating apparatus is smaller than the area of the nip portion for a period to heat the toner image, or the rotating member does not contact the back-up member for the predetermined period from the start of warming up the image heating apparatus.

23. The image heating apparatus according to claim 22, wherein the back-up member is roller, and wherein the roller is driven by a driving source and the rotating member is driven by a rotation of the roller.

24. An image heating apparatus for heating a toner image formed on a recording material while conveying the recording material at a nip portion, comprising:

a rotating member configured to contact the toner image, the rotating member including a heat generating layer; and a back-up member configured to contact the rotating member and form the nip portion between itself and the rotating member, wherein the entire circumference of the rotating member is heated by a current flowing into the heat generating layer, regardless of a rotation of the rotating member, and wherein the rotating member stops rotating for a predetermined period from a start of warming up the image heating apparatus.

25. The image heating apparatus according to claim 24, wherein the back-up member is a roller, and wherein the roller is driven by a driving source and the rotating member is driven by a rotation of the roller.

* * * * *